US005344539A

United States Patent [19]

Shinogi et al.

[11] Patent Number: 5,344,539

[45] Date of Patent: Sep. 6, 1994

[54] ELECTROCHEMICAL FINE PROCESSING APPARATUS

[75] Inventors: Masataka Shinogi; Toshihiko Sakuhara; Masayuki Suda; Fumiharu Iwasaki; Akito Ando, all of Tokyo, Japan

[73] Assignee: Seiko Instruments Inc., Tokyo, Japan

[21] Appl. No.: 38,118

[22] Filed: Mar. 29, 1993

[30] Foreign Application Priority Data

Mar. 30, 1992 [JP] Japan ..... 4-074734

[51] Int. Cl.[5] ..... C25F 3/02; C25F 7/00

[52] U.S. Cl. ..... 204/224 M; 204/227; 204/231

[58] Field of Search ..... 204/231, 226–227, 204/129.46, 224 M

[56] References Cited

U.S. PATENT DOCUMENTS 2,399,289 4/1946 Negus ..... 204/227 X
2,862,863 12/1958 Griffith ..... 204/227
3,445,354 5/1969 Carnell et al. ..... 204/227 X
3,852,176 12/1974 Rosenthal ..... 204/129.46
3,873,512 3/1975 Latanision ..... 204/129.46

*Primary Examiner*—Donald R. Valentine
*Attorney, Agent, or Firm*—Spensley Horn Jubas & Lubitz

[57] ABSTRACT

An electrochemical fine processing apparatus for electrochemically performing an adding processing and a removing processing of a substance such as a metal or a polymer in a solution in order to produce a structure having a high aspect ratio. Removing electrodes for applying an electric potential opposite to that applied to an addition electrode are disposed around the addition electrode, whereby an excess portion of metal or polymer film pattern can be scraped electrochemically. In addition, alternate electric potential pulses are applied successively to the addition electrode and then to the removing electrodes. It becomes possible to form on the support a structure with sharp pattern edge portions and a high aspect ratio.

5 Claims, 3 Drawing Sheets

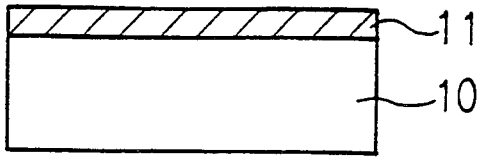
FIG. 3A
PRIOR ART
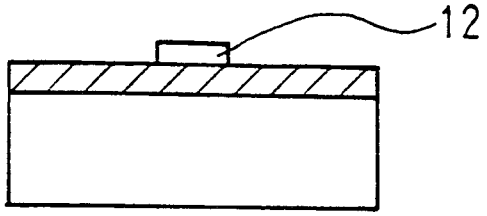
FIG. 3B
PRIOR ART
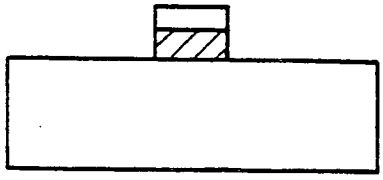
FIG. 3C
PRIOR ART
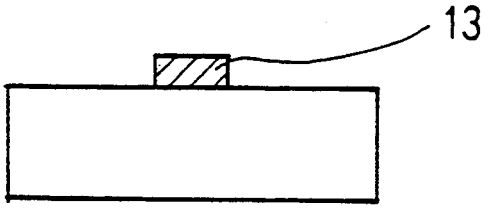
FIG. 3D
PRIOR ART
FIG. 4 PRIOR ART
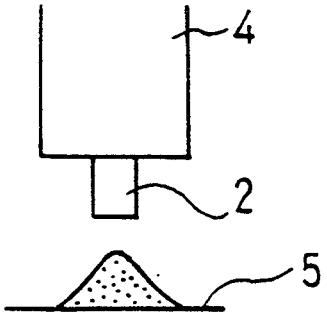

ELECTROCHEMICAL FINE PROCESSING APPARATUS

BACKGROUND OF THE INVENTION

The present invention relates to an electrochemical fine processing apparatus for electrochemically performing removal processing and addition processing of metal or polymer in a solution in order to produce a structure necessitating a high aspect ratio. It is especially used in a field in which the structure is manufactured using the micromachining technique.

One example of the conventional fine processing method is shown in FIGS. 3A–3D. This fine processing method uses photolithography represented by the semiconductor process (subtractive method). At first, a desired thin film 11 is formed on a substrate 10 made of silicon or the like using a sputtering method or a CVD method (FIG. 3A). Next, a resist pattern 12 is formed by spin coating or the like of a resist material, exposure of the resist material to a circuit structure pattern using a mask or an electron beam, and selective development of the resist material to leave the desired pattern 12 (FIG. 3B). Then, thin film 11 is selectively removed at regions not covered by resist pattern 12, using an etching liquid (FIG. 3C), and the remaining resist pattern 12 is removed to leave the thin film structure 13 (FIG. 3D).

In addition, in a fine processing method called the LIGA process, a photo-resist for X-ray is thickly coated on a substrate and is exposed to X-rays having strong linearity and strength generated from synchrotron radiation light. Thereby the resist can be formed deeply with a good pattern accuracy. Metal is formed on surface portions not covered with this pattern by means of electrocasting, and the resist is removed, whereby a structure having a high aspect ratio can be obtained.

However, in the conventional fine processing method, although a resolution of the order of submicron dimensions of the pattern can be achieved, it is difficult to perform film formation in the height direction, and it has been difficult to obtain a high aspect ratio. In addition, in the LIGA process, synchrotron equipment is necessary, which cannot be used easily and which creates the problem of increased cost.

Thus, there is also a method employing an electrochemical reaction in which a sample is allowed to approach a counter electrode with close distance, the sample being used as an acting electrode, and an addition electrode being used as the counter electrode, an electric current is allowed to flow between the addition electrode and the sample, whereby an electrochemical reaction is caused on the sample close to the addition electrode, so that metal or polymer is deposited on the sample. However, in such an electrochemical reaction method, as shown in FIG. 4, a high aspect ratio can be obtained, but the deposited substance 5 (metal and/or polymer) exhibits a film thickness distribution having no sharpness as shown in FIG. 4.

SUMMARY OF THE INVENTION

It is an object of the present invention to provide an electrochemical fine processing apparatus for forming a metal or polymer film pattern having a high aspect ratio and a sharp pattern edge by an electrochemical reaction.

In order to achieve the above-mentioned and other objects, there is added to the above-described apparatus a removing electrode for applying an electric potential opposite to that of the addition electrode around the addition electrode, whereby an excess portion of the metal or polymer film pattern can be scraped electrochemically.

In addition, an electric potential is applied successively for each pulse to the addition electrode and next to removing electrodes around the addition electrode, whereby with respect to the deposition of the metal or polymer film pattern and around the deposition portion, an electric potential opposite to that of the addition electrode is applied, thereby the metal or polymer film pattern can be scraped electrochemically.

The counter electrode, which consists of the addition electrode and the removing electrode, is allowed to approach the sample and electric current is caused to flow between the addition electrode and the sample. Deposition of the metal or polymer is made by an electrochemical reaction.

In addition, the removing electrodes, to which the electric potential opposite to that of the addition electrode is applied, are disposed around the addition electrode in order to scrape the metal or the polymer film pattern.

By scanning the counter electrode above the sample, an optional pattern can be formed on the sample.

BRIEF DESCRIPTION OF THE DRAWING

FIGS. 3A–3D are explanatory views showing a conventional fine processing method employing photolithography.

FIG. 4 is a pictorial view of the conventional film formation using an addition electrode only.

DESCRIPTION OF THE PREFERRED EMBODIMENTS

An example of this invention will be explained hereinafter with reference to the drawings.

Figure 1:
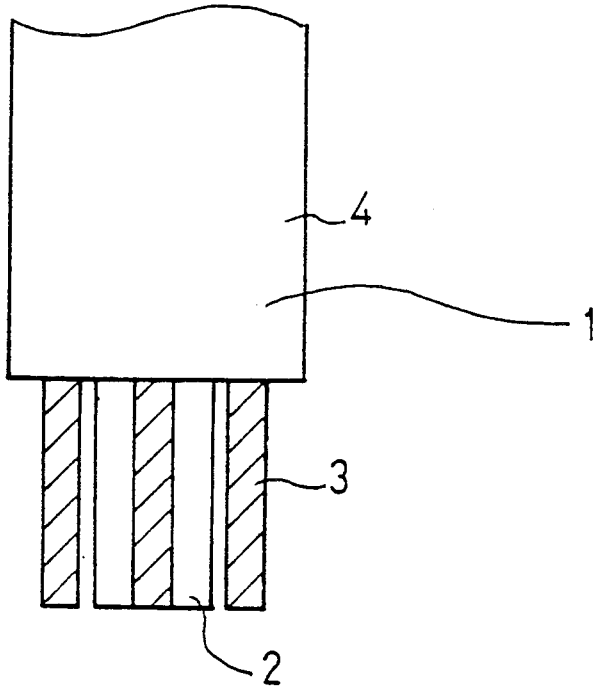
FIG. 1 is an elevational view, partly in cross section, of a counter electrode used for the fine processing apparatus of the present invention.
Figure 2:
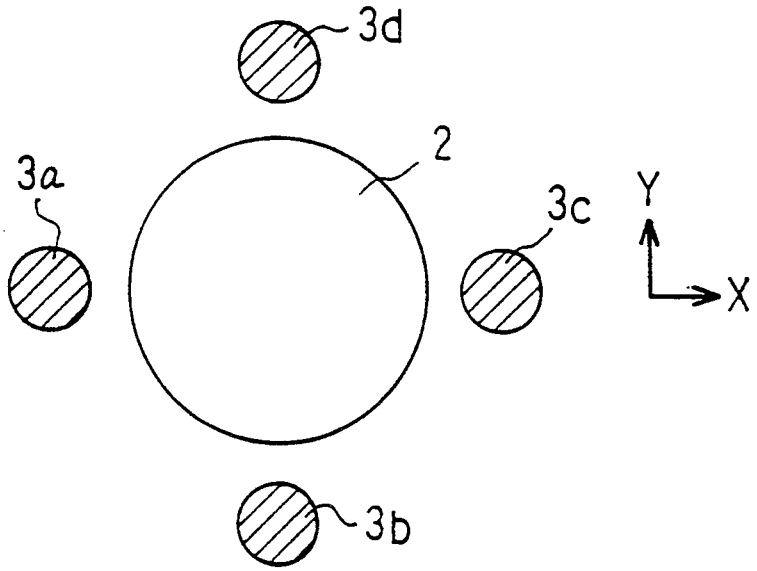
FIG. 2 is a cross-sectional plan view of the counter apparatus of the present invention. apparatus of the present invention.

FIG. 1 shows a partly cross-sectional view of a structure of a counter electrode 1 constituted by an addition electrode 2 and removing electrodes 3 (*3a*, *3b*, *3c* and *3d* in FIG. 2). The counter electrode 1 consists of the addition electrode 2 for performing film formation, the removing electrodes 3 for making the edge of a pattern sharp, and an insulating tube 4 for supporting the addition electrode 2 and the removing electrodes 3. For the addition electrode 2 and the removing electrodes 3, a metal such as tungsten, platinum or the like is used. The addition electrode 2 and the removing electrodes 3 extend through, and are supported by, the insulating tube 4. The addition electrode 2 and the removing electrodes 3 are covered by insulating material of tube 4 as extensively as possible. Around the addition electrode 2, the removing electrodes 3 for applying an electric potential opposite in polarity to that of the addition electrode 2 are supported by insulating tube 4 and, as illustrated in FIG. 2, are spaced from addition electrode 2 by a gap of 10 μm. The diameter of the addition electrode 2, which may be varied depending on the width of film formation, can be 500 μm in this case.

The structure of the addition electrode 2 and the removing electrodes 3 and the method of film formation will be described with reference to FIG. 2. The structure is such that the removing electrodes 3*a*–3*d* are provided around the addition electrode 2. Four removing electrodes 3*a*–3*d* are provided so as to surround the addition electrode 2 with a uniform spacing.

The film formation operation is performed by displacing counter electrode 1 in a controlled manner across a scanning plane having X and Y scanning directions. For example, in the case of driving in the X direction, an electric current is allowed to pass through the addition electrode to perform film formation, and then an electric current of opposite direction is allowed to pass through the removing electrodes 3*b* and 3*d*, so as to scrape the film under the removing electrodes 3*b* and 3*d*. During this period, no electric current is allowed to pass through the other removing electrodes 3*a* and 3*c*. By scanning in the X direction while performing film formation, both edges of the pattern which extend in the X direction are clearly and sharply formed.

When the film formation is performed in a diagonal direction, for example, an electric current is allowed to pass through the addition electrode 2 to perform film formation, and thereafter an electric current of opposite direction is allowed to pass through the removing electrodes 3*c* and 3*d*, and the film under the removing electrodes 3*c* and 3*d* is scraped. In the case of scanning in the diagonal direction, the control of the width of the pattern is determined by the number of circumferential electrodes 3, so that it is necessary to determine the number of the removing electrodes 3*a*–3*d* and the control method suitable for pattern accuracy. In addition, by providing the removing electrodes 3*a*–3*d* with a rotation mechanism, it is also possible to make them move to a portion desired to be removed and perform removal processing.

Figure 5:
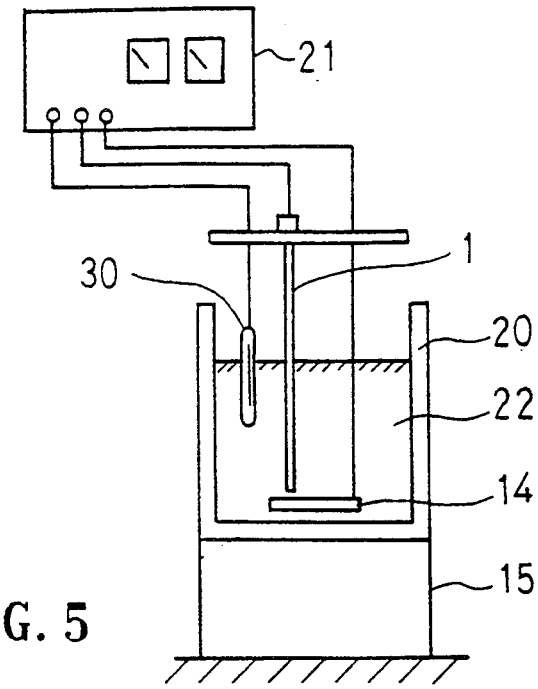
FIG. 5 is a pictorial view of the fine processing apparatus of the present invention.

FIG. 5 shows an illustrative view of a fine processing apparatus according to this invention. An electrochemical cell is constituted in a container 20 by a sample 14, a reference electrode 30, and the counter electrode 1 consisting of the addition electrode 2 and the removing electrodes 3. Further, the sample 14, the reference electrode 30, and the counter electrode 1 consisting of the addition electrode 2 and the removing electrodes 3 are electrically connected to a potentiostat 21. The sample 14 may be either an electrically conductive substance or an insulator which is coated with an electrically conductive substance. The reference electrode 30 is an electrode for generating an electric potential to serve as a standard for the case of controlling electric potential of the counter electrode in the electrochemical reaction, for which a saturated calomel electrode (SCE) or a silver-silver chloride electrode is generally used. For the electrodes for constituting the addition electrode 2 and the removing electrodes 3, tungsten or platinum is used.

The electrochemical cell of the present invention is installed on a vibration-isolating stand 15 in order to suppress distance fluctuations between the sample 14 and the addition electrode 2 and the removing electrodes 3.

The movement of the counter electrode 1 includes X, Y movement and a Z movement. The X, Y movement is performed by a coarse movement mechanism not shown in the figure (for example a magnet mechanism). The Z axis movement is performed using a coarse mechanism (not shown in the figure, for example a ball nut screw) and a fine movement mechanism (not shown in the figure, for example a piezoelectric element). By using a piezoelectric element for the fine movement mechanism, movement control of the order of several microns is performed by controlling the voltage applied to the piezoelectric element, and larger movements are performed by the coarse movement mechanism. By controlling the Z axis movement as described above, a film structure having a high aspect ratio can be obtained. With respect to the movement of the counter electrode 1, it becomes possible to move along the X, Y and Z axes directions.

A chromium film formation method using the apparatus of the present invention will be described. A mixed solution of chromic acid and sulfuric acid is poured into the container 20, in which the sample 14, the reference electrode 30 and the counter electrode 1 are immersed, so as to constitute an electrochemical cell. Further, the sample 14, the reference electrode 30 and the counter electrode 1 are connected to the potentiostat 21. The tip of the counter electrode is moved to a position at which the processing of the sample is intended to be performed by means of the X-Y movement mechanism. At the processing portion, using the Z axis movement mechanism, the counter electrode 1 is allowed to approach the sample (see FIG. 6A).

Next, using the potentiostat 21, the electric potential of the addition electrode 2 is set to an electric potential at which material is deposited from the solution onto the sample 14. By doing so, the electrochemical reaction occurs in the vicinity of the tip of the addition electrode 2, and a thin film of chromium is formed on the sample surface.

Figure 6A:
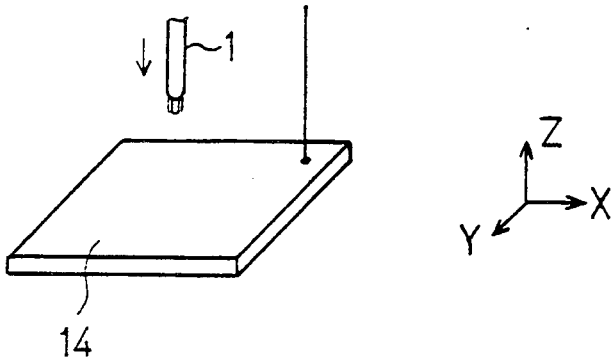
FIGS. 6A–6C are explanatory perspective views showing the pattern formation method according to the present invention.
Figure 6B:
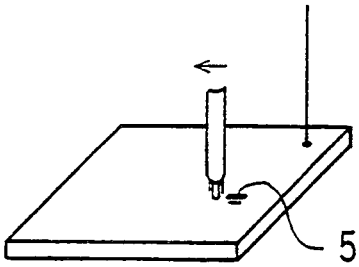
Figure 6C:
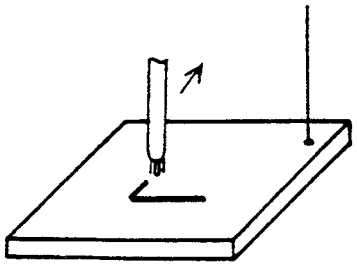

Next, an opposite electric potential is applied to the removing electrodes 3, whereby portions of the formed thin film are removed. When such operation is effected by applying successive pulses in alternation to the addition electrode 2 and the removing electrodes 3, the addition processing and the removing processing can be performed, and a pattern with sharp pattern edge portions is obtained. When a desired pattern is formed, using the Z axis movement mechanism (not shown in the figure), the counter electrode 1 is allowed to approach the sample as shown in FIG. 6A, subsequently an electric potential is applied to the addition electrode 2 to deposit metal or polymer film, and the opposite electric potential is applied by the removing electrodes 3 so as to scrape the pattern edge portions. The counter electrode 1 is scanned with the X-Y movement mechanism (not shown in the figure), whereby the desired pattern can be formed (see FIGS. 6B and 6C).

In this invention, as explained above, in the electrochemical cell in which the sample 14, the counter electrode 1 and the reference electrode 30 are installed in the solution, the sample 14 is allowed to approach the addition electrode 2 of the counter electrode 1 to a close distance, and the electric current is allowed to flow between the sample 14 and the addition electrode 2, whereby the electrochemical reaction is performed to deposit the metal or polymer film pattern on the sample 14, and there are added the removing electrodes 3 for applying the electric potential opposite to that of the addition electrode 2 around the addition electrode 2, whereby the metal or polymer film can be scraped, so that there is such an effect that a structure which has sharp pattern edge portions with a high aspect ratio due to electrochemical reaction can be obtained.

This application relates to subject matter disclosed in Japanese Application number 4-74734, filed on Mar. 30, 1992, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. An electrochemical fine processing apparatus for forming a film structure on a support comprising: a container adapted to contain an electrolytic solution in which the support is immersed; an addition electrode adapted to be dipped in the electrolytic solution in close proximity to the support for effecting deposition of a substance from the electrolytic solution on the support by electrochemical reaction when a first potential is applied to said addition electrode; a removing electrode disposed adjacent to said addition electrode for scraping a part of the deposited substance on the support by electrochemical reaction when a second electric potential is applied to said removal electrode, wherein the second electric potential is of opposite polarity to the first electric potential; and potential supplying means for applying the first electric potential to said addition electrode and the second electric potential to said removing electrode, respectively.

2. An apparatus according to claim 1, wherein said potential supplying means alternately applies the first electric potential to said addition electrode for depositing the substance and the second electric potential to said removing electrode for scraping a part of the deposited substance, and wherein said addition electrode and said removing electrode are moved above the support to form a predetermined pattern of the deposited substance.

3. An apparatus according to claim 1, wherein there are a plurality of said removing electrodes disposed around said addition electrode.

4. An apparatus according to claim 1, wherein the substance disposed on the support is a metal.

5. An apparatus according to claim 1, wherein the substance disposed on the support is a polymer.

* * * * *